US010206547B2

(12) United States Patent
Bouton

(10) Patent No.: US 10,206,547 B2
(45) Date of Patent: Feb. 19, 2019

(54) LIQUID DISPENSING WAND DEVICE AND SYSTEM FOR CLEANING

(71) Applicant: SUPERSTREAM CLEANER LLC, Newburyport, MA (US)

(72) Inventor: Christopher M. L. Bouton, Newbury, MA (US)

(73) Assignee: Superstream Cleaner LLC, Newburyport, MA (US)

( * ) Notice: Subject to any disclaimer, the term of this patent is extended or adjusted under 35 U.S.C. 154(b) by 170 days.

(21) Appl. No.: 15/402,985

(22) Filed: Jan. 10, 2017

(65) Prior Publication Data

US 2017/0202411 A1 Jul. 20, 2017

Related U.S. Application Data

(60) Provisional application No. 62/280,422, filed on Jan. 19, 2016.

(51) Int. Cl.

| | |
|---|---|
| ***B08B 13/00*** | (2006.01) |
| ***A47K 11/10*** | (2006.01) |
| ***E03D 9/00*** | (2006.01) |
| ***B05B 15/62*** | (2018.01) |
| ***B05B 12/20*** | (2018.01) |
| ***E03D 9/08*** | (2006.01) |
| ***B05B 1/28*** | (2006.01) |
| ***B05B 15/63*** | (2018.01) |
| *B05B 9/08* | (2006.01) |

(52) U.S. Cl.

CPC ..... *A47K 11/10* (2013.01); *B05B 1/28* (2013.01); *B05B 12/20* (2018.02); *B05B 15/62* (2018.02); *B05B 15/63* (2018.02); *E03D 9/005* (2013.01); *E03D 9/085* (2013.01); *B05B 9/0861* (2013.01)

(58) Field of Classification Search

None

See application file for complete search history.

(56) References Cited

U.S. PATENT DOCUMENTS

| | | | |
|---|---|---|---|
| 3,892,004 | A | 7/1975 | Downes |
| 4,397,056 | A | 8/1983 | Miller |
| 5,890,898 | A | 4/1999 | Wada et al. |
| 6,785,915 | B1 | 9/2004 | Daugherty |
| 6,789,552 | B1 | 9/2004 | Robinson et al. |
| 2014/0261534 | A1 | 9/2014 | Schepis |

OTHER PUBLICATIONS

The Loogun, Published on Jul. 1, 2015, https://www.youtube.com/watch?v=m-bfwD6xVp8.

For 100 years we've cleaned the toilet with a brush. Isn't it time for a change? http://www.loogun.com/press/entry/launch_release, Jun. 29, 2015.

*Primary Examiner* — Eric W Golightly

(74) *Attorney, Agent, or Firm* — Sean D. Detweiler, Esq.; Morse, Barnes-Brown & Pendleton, P.C.

(57) ABSTRACT

A cleaning system for generating a liquid jet via a liquid dispensing wand, includes an elongate tube having a first end and a second end. A nozzle is disposed at the second end of the elongate tube. A splash guard is slidably coupled with the elongate tube, and is slidable longitudinally between the first end and the second end of the elongate tube. A basin is configured to hold a liquid. A conduit fluidly couples the basin to the liquid dispensing wand. A mount removably stores the liquid dispensing wand when not in use. With the splash guard disposed proximal the second end and the nozzle, placement of the liquid dispensing wand into the mount for storing causes the splash guard to slide from the second end to the first end of the elongate tube.

18 Claims, 15 Drawing Sheets

LIQUID DISPENSING WAND DEVICE AND SYSTEM FOR CLEANING

CROSS-REFERENCE TO RELATED APPLICATION(S)

This application claims priority to, and the benefit of, U.S. Provisional Application No. 62/280,422, filed Jan. 19, 2016, for all subject matter common to both applications. The disclosure of said provisional application is hereby incorporated by reference in its entirety.

FIELD OF THE INVENTION

The present invention relates to a liquid dispensing wand device and system suitable for cleaning various surfaces. In particular, the present invention relates to a liquid dispensing wand with a splash guard, capable of producing a high pressure stream of liquid to clean contaminants from surfaces while protecting a user operating the wand from spray reflected back toward the wand from the surfaces.

BACKGROUND

Generally, many different surfaces, including those of toilets and other bathroom fixtures, require regular cleaning to reduce buildup of contaminants, waste, and/or other material. Conventional consumer products for cleaning a toilet and other ceramic fixtures have been limited to variations of the common toilet brush. The cleaning process traditionally consists of applying a cleaning solution around a bowl of the fixture and using an abrasive brush to scrub the surface and work in the cleaning solution. It is also common to use the water from the ceramic fixture or toilet bowl in combination with the applied cleaning solution to assist in the cleaning process.

However, the conventional design of traditional toilet brushes and cleaning methodologies experience some shortcomings. Toilet brushes require the user to bend down over the toilet and scrub the surface of the toilet or other fixture, which can cause physical discomfort and can be difficult for certain users (e.g., elderly, chronic pain suffers, etc.). Additionally, once a user finishes cleaning the ceramic surface, the brush is returned to a stand or carrying device. Storage of the brush can be unsanitary because portions of the waste material that was removed from the toilet or other fixture surface can remain on the brush. Moreover, conventional toilet brushes can require a user to scrub with a significant amount of force to remove stains or accumulated waste material, creating a labor intensive process.

Other surface cleaning devices generally include the category of a pressurized liquid emitting from, e.g., a nozzle, against the surface to be cleaned. For example, pressure washers or power washers are known for delivering a high pressure liquid stream using a hose or nozzle. These devices are primarily designed for outside heavy duty cleaning applications and not designed for indoor usage. There are toilet cleaning devices that make use of a pressurized sprayer to clean toilet surfaces, such as in U.S. Pat. No. 6,789,552. Such devices can spray a toilet bowl or other ceramic surface with streams of water to clean the surfaces. However, whether cleaning toilets or other surfaces, these known pressurized washers all experience shortcomings, including that they all create overspray and/or reflective splash back, which can result in the user or operator of the washer being exposed to the contaminated water and waste material splashing onto their bodies, and can additionally result in the surrounding surfaces being covered with the same waste material, including the washer itself (as with toilet brushes). These shortcomings are undesirable, and in the case of cleaning toilets, are unsanitary, making them insufficient solutions.

SUMMARY

There is a need for a cleaning device or system that overcomes the deficiencies of traditional power washers, as well as toilet brushes and other cleaning tools in the toilet cleaning field of use. The present invention is directed toward further solutions to address this need, in addition to having other desirable characteristics. Specifically, the present invention is directed to a handheld liquid dispensing wand configured for spraying pressurized water to clean a surface, the wand including a splash guard to protect a user and other portions of the device from overspray and spray back during use. The wand is attached to a base station including a liquid basin that can hold a combination of water and/or cleaning solution. The liquid dispensing wand can be electrically powered to provide a stream of the contents of the liquid basin throughout a cleaning process. Once the cleaning process is complete, the splash guard can be slidably attached to the liquid dispensing wand such that the wand will return to a resting position at a top end of the base station while the remainder of the liquid dispensing wand is stored within the base station. Alternatively, the splash guard can be removed for cleaning and re-use, or can be disposed of, to avoid storage of a device containing contaminants, and the wand can be returned to the base station free from contaminants.

In accordance with an embodiment of the present invention, a liquid dispensing wand is provided. The liquid dispensing wand includes an elongate tube having a first end and a second end, a nozzle disposed at the second end of the elongate tube, and a splash guard slidably coupled with the elongate tube. The splash guard is slidable longitudinally between an operational position proximal the first end of the elongate tube and a storage position proximal the second end of the elongate tube.

In some implementations, the splash guard includes a flat structure, a curved structure, an angled structure, or an irregular shaped structure. In some implementations, the splash guard includes a disk shaped structure. In some implementations, the splash guard is oriented orthogonally to a longitudinal axis of the elongate tube. In some implementations, the elongate tube is rigid. In some implementations, the nozzle is structured to generate a liquid jet when pressurized liquid is supplied to the nozzle through the elongate tube.

In some implementations, the wand further includes a mechanical stop disposed proximal the second end and the nozzle and the mechanical stop prevents the splash guard from sliding beyond the mechanical stop and reaching the nozzle and holding the splash guard in the operational position. In some implementations, the mechanical stop also includes a fastening mechanism. In some implementations, the fastening mechanism releasably couples the splash guard to the mechanical stop in the operational position of the splash guard. In some implementations, the fastening mechanism includes a first magnet coupled with the mechanical stop and a second magnet coupled with the splash guard, the first magnet and second magnet being oriented to magnetically couple with each other.

In some implementations, the splash guard is slidably coupled with the elongate tube by a mounting bracket that is itself slidable longitudinally between the first end and the second end of the elongate tube, thereby enabling the splash guard to be slidable longitudinally between the operational position proximal the first end of the elongate tube and the storage position proximal the second end of the elongate tube. In some implementations, the splash guard is comprised of a washable, reusable, material and structure. In some implementations, the splash guard is comprised of a disposable material and structure. In some implementations, the splash guard is comprised of a biodegradable material and structure. The splash guard is comprised of a flushable and septic tank compliant material and structure.

In some implementations, an actuator is disposed proximal the first end of the elongate tube and is operable to decouple the splash guard from the elongate tube when the splash guard is in the operational position proximal the second end. In some implementations, when the splash guard is positioned in the operational position proximal the second end of the elongate tube, reflected spray bouncing off of a target surface receiving liquid jetting from the nozzle of the liquid dispensing wand impacts the splash guard and does not reach the first end of the elongate tube, thereby guarding a user's hand operating the liquid dispensing wand from the first end of the elongate tube.

In accordance with an embodiment of the present invention, a cleaning system is provided. The cleaning system includes a liquid dispensing wand. The liquid dispensing wand includes an elongate tube having a first end and a second end, a nozzle disposed at the second end of the elongate tube, and a splash guard slidably coupled with the elongate tube, the splash guard being slidable longitudinally between the first end and the second end of the elongate tube. The cleaning system also includes a basin configured to hold a liquid, a conduit fluidly coupling the basin to the liquid dispensing wand, and a mount removably storing the liquid dispensing wand when not in use. The splash guard is disposed proximal the second end and the nozzle and placement of the liquid dispensing wand into the mount for storing causes the splash guard to slide from the second end to the first end of the elongate tube.

In some implementations, when the liquid dispensing wand is placed into the mount, the splash guard impacts a structure of the cleaning system that prevents the splash guard from moving with the elongate tube and instead causes the elongate tube and the splash guard to slide relative to each other, longitudinally moving the splash guard from the second end to the first end of the elongate tube.

In accordance with an embodiment of the present invention, a method for cleaning a toilet is provided. The method includes filling a liquid basin within a base station with water and/or cleaning solution. The method also includes removing a handheld liquid dispensing wand from the base station. The method further includes positioning a splash guard at a first end of the liquid dispensing wand. The method also includes initiating a liquid jet stream from the liquid dispensing wand using the water and/or cleaning solution from the liquid basin, using the liquid jet stream to clean waste material from a surface of a toilet bowl, and returning the handheld liquid dispensing wand to the base station.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1A:
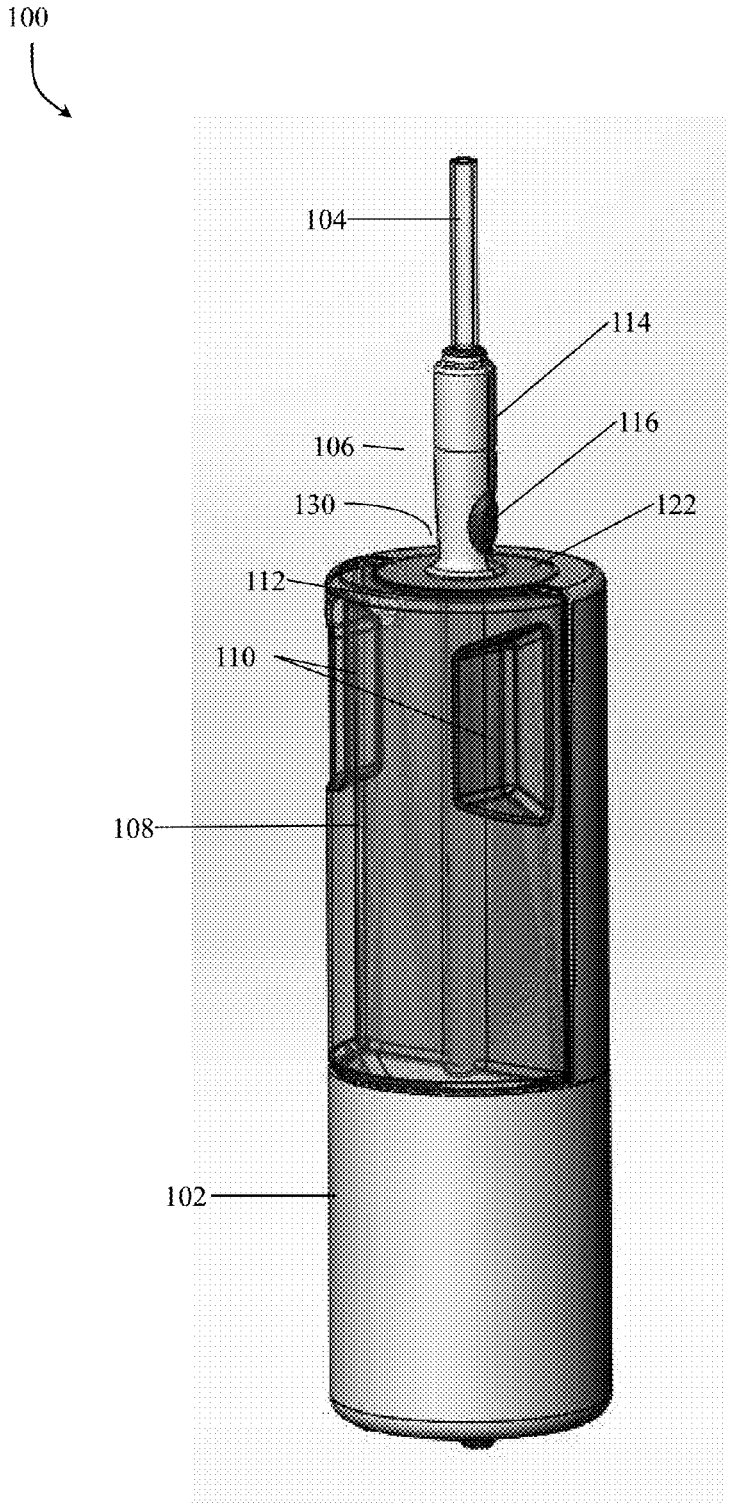
FIGS. 1A and 1B are alternative illustrative views of a system for cleaning, in accordance with the present invention.

An illustrative embodiment of the present invention relates to a system capable of creating a pressurized stream of liquid to be used in cleaning applications. In particular, the present invention relates to system including a handheld liquid dispensing wand configured to spray a pressurized stream of liquid for washing surfaces of objects, including toilet bowls, with improved sanitary functionality. More specifically, the handheld liquid dispensing wand includes a splash guard configured to protect the user and other portions of the wand from any splash back and overspray created by the stream of liquid during operation. The handheld liquid dispensing wand is connected, via a flexible hose, to a base station that supplies the liquid for the liquid stream, and in combination, result in the system for cleaning. The base station includes a liquid basin designed to hold a volume of water and/or cleaning solution. The volume of liquid is pumped from the liquid basin to a nozzle of the handheld liquid dispensing wand. Additionally, the removable splash guard can be slidably attached to the handheld liquid dispensing wand to be positioned in a first location during operation and a second location during storage. In accordance with an alternative embodiment, the splash guard can be fixedly attached at a single location on the liquid dispensing wand, and/or the splash guard can be detachable, cleanable, and reusable.

FIGS. 1A through 13, wherein like parts are designated by like reference numerals throughout, illustrate an example embodiment or embodiments of a liquid dispensing wand with splash guard and system for cleaning, according to the present invention. Although the present invention will be described with reference to the example embodiment or embodiments illustrated in the figures, it should be understood that many alternative forms can embody the present invention. One of skill in the art will additionally appreciate different ways to alter the parameters of the embodiment(s) disclosed, such as the size, shape, or type of elements or materials, in a manner still in keeping with the spirit and scope of the present invention.

Figure 1B:
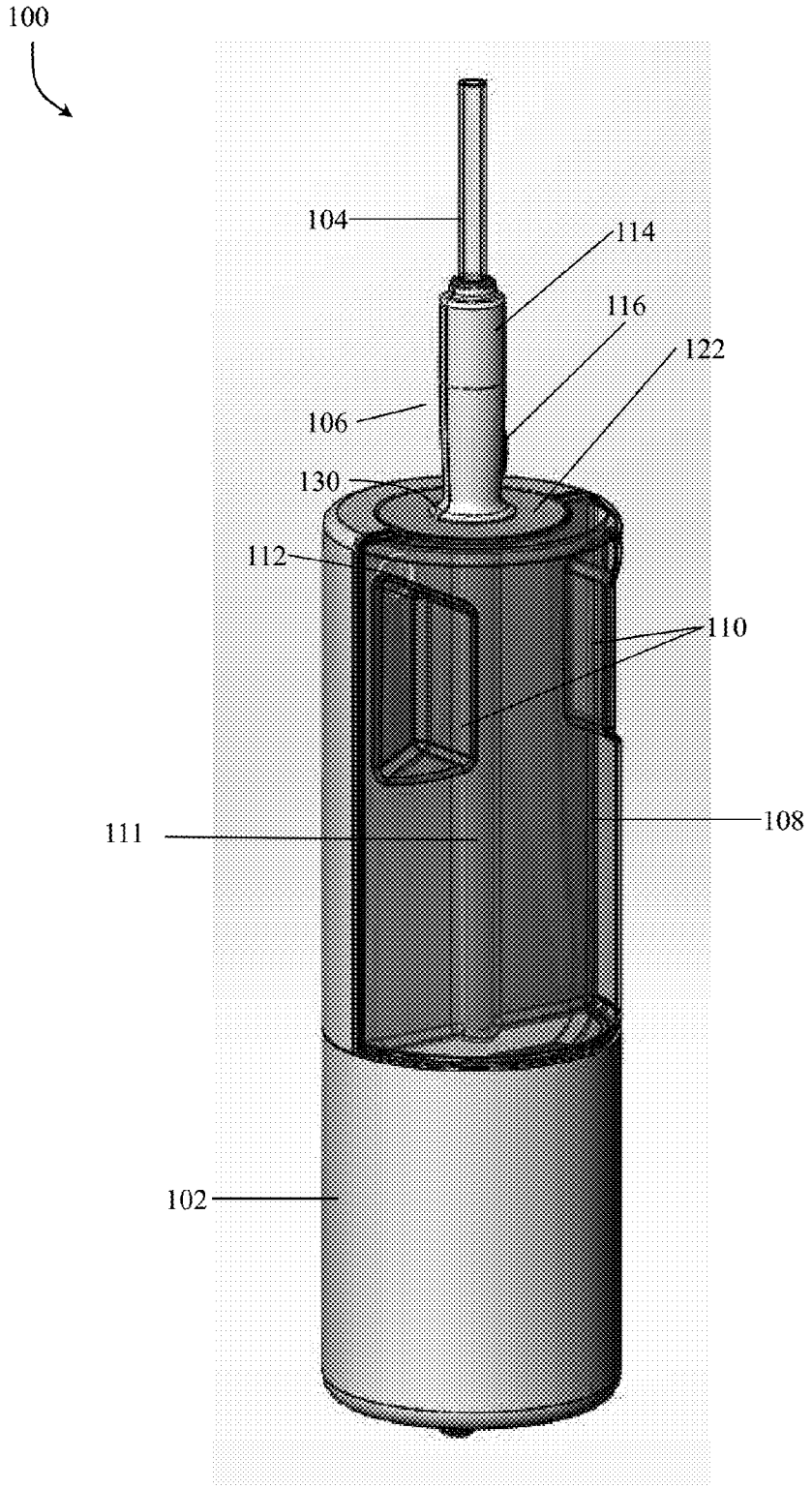

FIGS. 1A and 1B depict two views of a system 100 for cleaning a surface of an object, described herein with the illustrative example of cleaning a toilet bowl or other fixture. The system 100 includes a fluidly coupled base station 102, hose 104, and handheld liquid dispensing wand 106. The base station 102 is connected to one end of the hose 104 and the handheld liquid dispensing wand 106 is connected to the other end of the hose 104. As would be appreciated by one skilled in the art, the base station 102, the hose 104, and the handheld liquid dispensing wand 106 can all be coupled to one another using any methods known in the art to supply pressurized liquid to the handheld liquid dispensing wand 106 from the base station 102. The hose 104 can also include any type of suitable conduit fluidly coupling the basin to the handheld liquid dispensing wand 106. The hose 104 can include a channel for carrying liquid and wiring for carrying control signals, if desired. As would be appreciated by one skilled in the art, the hose 104 can include the liquid channel and a second wiring channel in a single insulated structure. Alternatively, the hose 104 can be limited to a liquid channel in the form of a conventional hose or tube without any additional structural elements.

The base station 102 is a housing including a liquid basin 108 or reservoir and any combination of mechanical and electrical components necessary for carrying out aspects of the present invention. The combination of mechanical and electrical components can be any components necessary to pump water from the liquid basin 108 (or any desired reservoir or source of liquid), through the hose 104, to the handheld liquid dispensing wand 106 for spraying liquid during operation. The mechanical and electrical components include a power supply, an electro/mechanical water pump, an actuator mechanism, and circuitry to receive commands to initiate and stop the water pump, and otherwise manage the pressure and delivery of the liquid to the handheld liquid dispensing wand 106. As would be appreciated by one skilled in the art, the usage of a pump or pumping can include any combination of electro/mechanical means configured to displace a volume of liquid. Additionally, the power supply can be any combination of direct wired power from an outlet or battery powered. For example, the power supply can include a rechargeable battery power pack that can be recharged at a base station or can be hard wired with a plug and include replaceable battery backups, or can be a long life single time use battery, or any other variation on power source as would be sufficient to power the electro/mechanical pump and other electronic and powered components of the system 100.

In accordance with an example embodiment of the present invention, the electro/mechanical pump includes any type of electric and/or mechanical pump operable to pump liquid from the liquid basin 108, through the hose 104, to the handheld liquid dispensing wand 106 with sufficient pressure to provide an adequate spray for cleaning applications. The circuitry within the base station 102 is configured to receive electrical signals to initiate or stop operation of the system 100 and transmit the appropriate signals to activate and deactivate the electrical and mechanical components for such operations. In accordance with an example embodiment of the present invention, the base station 102 includes an actuating device configured to transmit electrical signals to initiate or stop operation of the electro/mechanical pump, as discussed in greater detail with respect to FIG. 2. As would be appreciated by one skilled in the art, the mechanism for initiating a stop and start electrical signal for operation of the electro/mechanical pump can be located at a different locations within the system 100. For example, the handheld liquid dispensing wand 106 can include a mechanism that when activated transmits an electrical control signal to the circuitry of the base station 102 to initiate a stream of liquid via the electro/mechanical pump.

Figure 2:
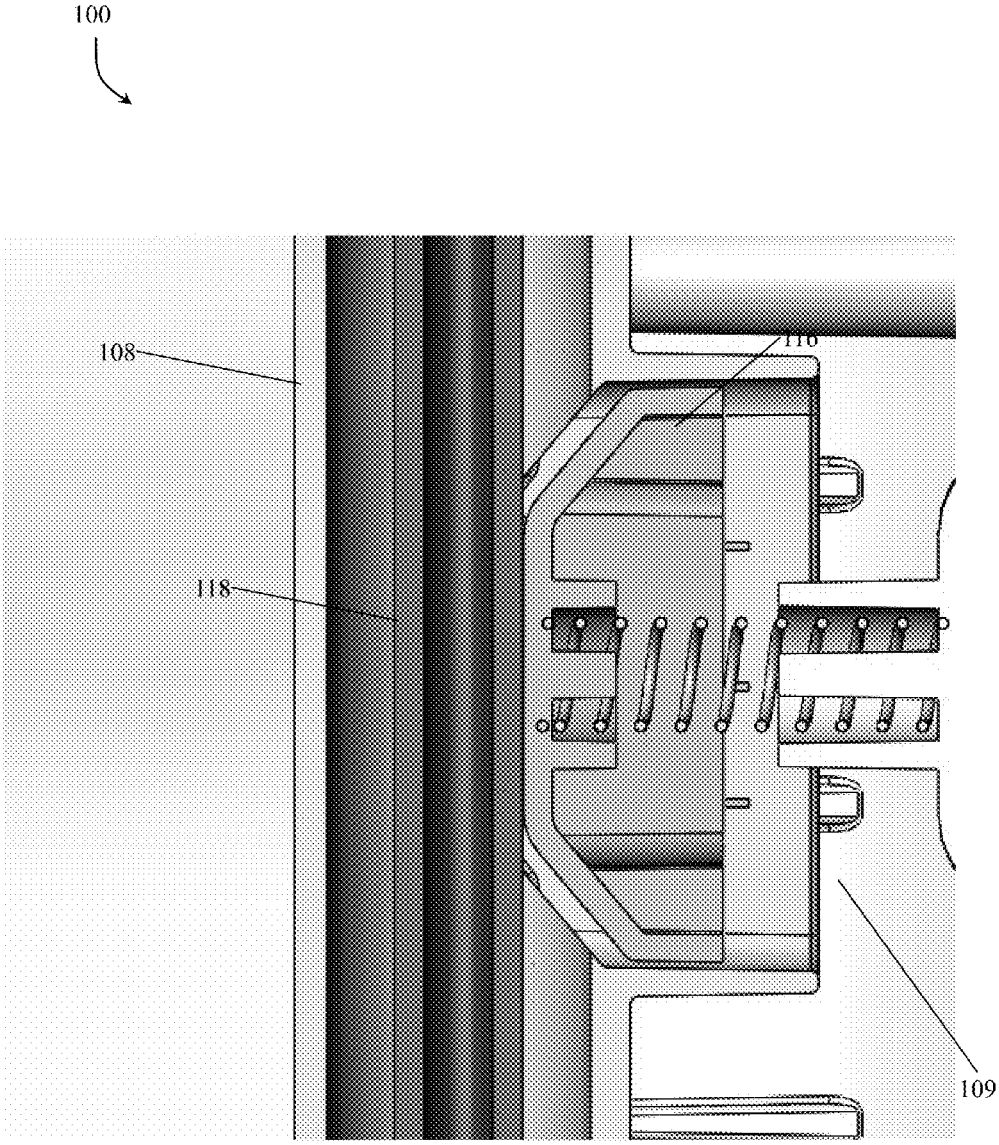
FIG. 2 is an illustrative cross-sectional depiction of an actuator for initiating operation of a system, in accordance with the present invention.

In accordance with an example embodiment of the present invention, FIG. 2 depicts an actuating device 109 for controlling the activation and deactivation of the electro/mechanical pump as discussed with respect to FIGS. 1A and 1B. In particular, FIG. 2 depicts a spring loaded actuating device 109 that activates the electro/mechanical pump when the handheld liquid dispensing wand 106 is removed from a storage position (e.g., holster) within the base station 102 and deactivates the pump when the handheld liquid dispensing wand 106 is reinserted into the base station 102. As would be appreciated by one skilled in the art, activation does not necessarily mean create a flow of liquid from a nozzle 120, but rather means pressurizing the dispensing liquid. As depicted in FIG. 2, when the handheld liquid dispensing wand 106 is inserted into the base station 102, the actuating device 109 is pushed back into a recess and deactivates the electro/mechanical pump (e.g., disconnecting the electrical signal). Similarly, when the handheld liquid dispensing wand 106 is removed from the base station 102, a spring force pushes the actuating device 109 outward to cause an electrical signal to initiate and activate the electro/mechanical pump. As would be appreciated by on skilled in the art, the actuating device 109, as depicted in FIG. 2, can include any type of electrical and/or mechanical actuating device capable of transmitting an electrical control signal to activate and deactivate a pumping device. For example, the actuating device 109 can include an electrical switch located on the base station 102 or on the handle of the handheld liquid dispensing wand 106 configured to activate and deactivate the electromechanical pump in accordance with the present invention.

In accordance with an example embodiment of the present invention, the liquid basin 108 can be included within or otherwise be attached to the base station 102. As would be appreciated by one skilled in the art, the liquid basin 108 can be any liquid tight container suitable for holding various types of liquids. For example, the liquid basin 108 can be any container suitable for holding a combination of water and cleaning solutions. As would be appreciated by one skilled in the art, the liquid basin 108 can be configured to hold a combination of liquid and liquid soluble cleaning solutions. For example, the liquid basin 108 can receive and hold a combination of water and water soluble detergent cleaning solution. In accordance with an example embodiment of the present invention, the liquid basin 108 can be removable from the rest of the base station 102 housing, allowing a user easy access to empty, fill, or clean the liquid basin while leaving the remainder of the base station 102 in place. For example, the liquid basin 108 can be removed by a user and filled up with water from a sink and reattached to the base station 102. In accordance with an example embodiment of the present invention, the liquid basin 108 can include a grip 110 to allow a user a simple mechanism to grip the liquid basin 108 for removal. For example, the liquid basin 108 can include grip(s) 110 in the form of recessed hand grips, rubber grips, textured grips, or a combination thereof.

Figure 3:
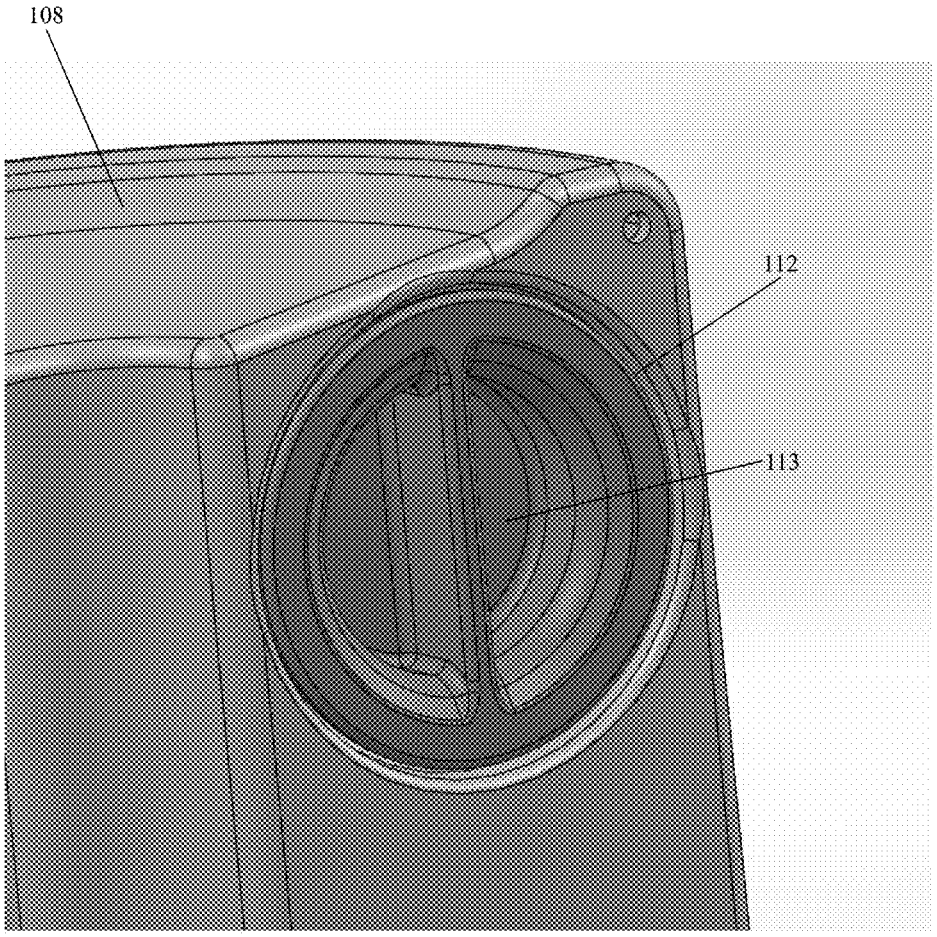
FIG. 3 is an illustrative depiction of an access point with a cap for filling the system with liquid, in accordance with the present invention.

In accordance with an example embodiment of the present invention, the liquid basin 108 can include one or more access point(s) 112 for receiving and supplying the liquid to the handheld liquid dispensing wand 106. For example, the liquid basin 108 can include an access point 112 to allow a user or water supply system to fill the liquid basin 108. FIG. 3 depicts an example implementation of an access point 112 in accordance with the present invention. In particular, FIG. 3 depicts an access point 112 for filling the liquid basin 108 with liquid and a cap 113 for sealing the access point 112. The cap 113 can be placed within the access point 112 to prevent liquid from spilling out from the access point 112 during transportation from a filling location (e.g., a sink) to the base station 102. As would be appreciated by one skilled in the art, the cap 113 can include any sort of cap known in the art. For example, the cap 113 can be a screw in/on cap, a friction force cap, etc.

Additionally, the one or more access point(s) 112 can be used to supply the liquid basin 108 with a water supply directly from direct or intermediate plumbing. For example, the base station 102 can include a water input line to receive water from the local plumbing lines and feed water into the liquid basin 108 via the access point(s) 112. In an additional example, the base station 102 can include a water input line from the toilet or other fixture water supply. As would be appreciated by one skilled in the art, the water input line can include any construction to allow liquid to flow freely from the liquid basin 108 to the water pump without leakage. In accordance with an example embodiment of the present invention, the liquid basin 108 can include an access point 112 to supply the liquid solution residing therein to the water pump. For example, the electro/mechanical pump can have an input line that feeds from the pump to the liquid basin 102 via an access point 112 to provide the liquid for pumping.

Figure 4:
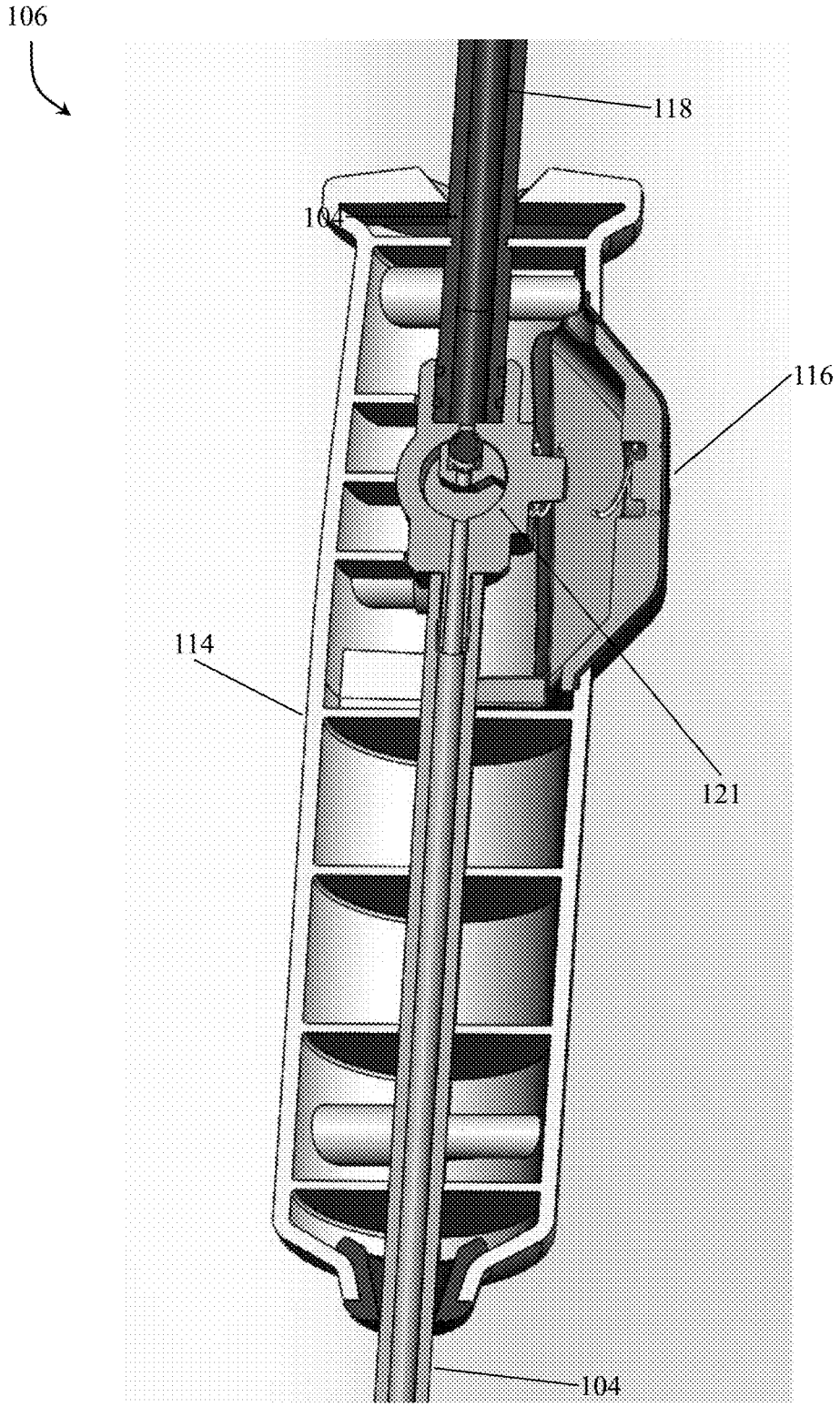
FIG. 4 is an illustrative cross-sectional depiction of an actuator for initiating a flow of liquid from a system, in accordance with the present invention.

In accordance with an example embodiment of the present invention, the handheld liquid dispensing wand 106 includes a handle 114 with an actuator 116, an elongate tube 118, a nozzle 120, and a splash guard 122. The handle 114 can be formed in an ergonomic shape to allow a user to easily grip and control the handheld liquid dispensing wand 106 during the cleaning process. The handle 114 can include the actuator 116 for controlling the flow of water from the nozzle 120. As would be appreciated by one skilled in the art, the actuator 116 can include any device (e.g., switch, button, actuator, etc.) to initiate a flow of water from the base station 102 through the hose 104 to the nozzle 120. In accordance with an example embodiment of the present invention, the actuator 116 is a mechanical button that controls the flow of water from the base station 102 to the nozzle 120, as depicted in FIG. 4. In particular, FIG. 4 depicts a mechanical actuator 116 that can open and close a mechanical valve 121 when depressed/released. When a user presses the actuator 116 depicted in FIG. 4, the valve 121 is opened, releasing the pressurized flow of water in the hose 104 being pumped from the base station 102. Similarly, the user can release the actuator 116 and the valve 121 will close to stop the flow of pressurized water. As would be appreciated by one skilled in the art, the actuator 116 can include any combination of electrical and mechanical mechanisms for initiating and ceasing a flow of water from the hose 104. For example, the actuator 116 can initiate an electrical signal to the circuitry within the base station 102 to control the flow of liquid from the liquid basin 108.

Additionally, as would be appreciated by one skilled in the art, the actuator 116 can also be configured to control the amount of pressure or force of the flow of liquid through the nozzle 120. The pressure of force of the flow of liquid can be controlled by an amount of pressure applied by the user to the actuator 116. As would be appreciated by one skilled in the art, the amount of pressure applied to the actuator can cause the valve 121 to open larger or smaller and thus modify the flow of liquid. Additionally, the pressure of force of the flow of liquid can, be controlled using other means known in the art. For example, the force or pressure can be managed by circuitry modifying control signals to the electro/mechanical pump and receiving feedback of a sensor or other indicator as to the pressure of the liquid.

In accordance with an example embodiment of the present invention, the elongate tube 118 is a rigid tube that has a first end 118*b* and a second end 118*b*. The nozzle 120 is disposed at the first end 118*a* of the elongate tube 118 and the handle 114 is disposed at the second end 118*b* of the elongate tube 118. As would be appreciated by one skilled in the art, the handle 114, the elongate tube 118, and the nozzle 120 can be coupled to one another using any combination of methods known in the art (e.g., bolt, weld, screw, etc.). The nozzle 120 is structured to generate a liquid jet when pressurized liquid is supplied to the nozzle 120 from the liquid basin 108 through the hose 104 and elongate tube 118. In accordance with an example embodiment of the present invention, the direction and amount of spray of the liquid can be adjusted by the nozzle 120. For example, the nozzle 120 can be rotated to adjust velocity and/or the shape of the spray of liquid.

Figure 5A:
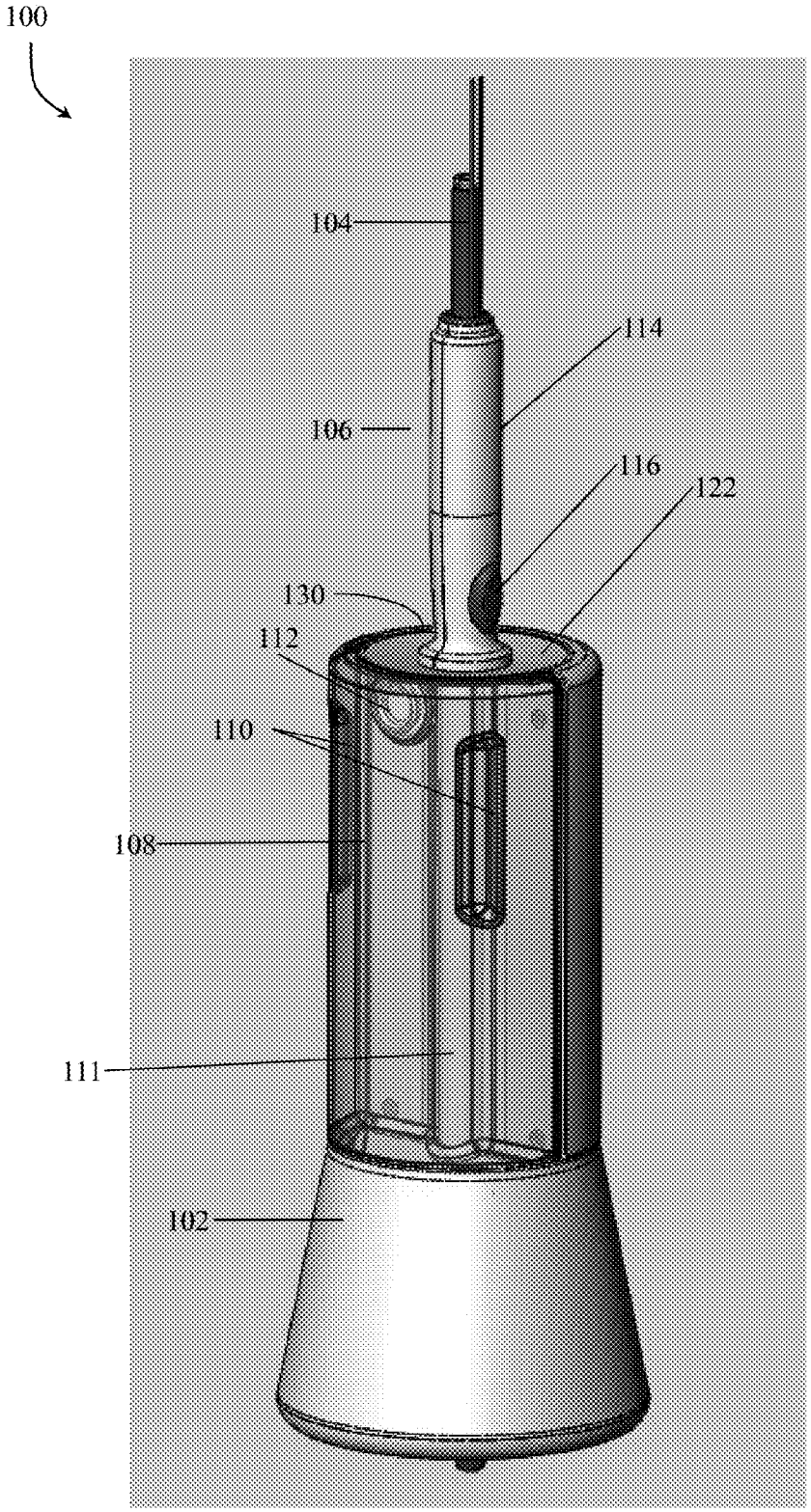
FIGS. 5A and 5B are illustrative depictions of variations on a system for cleaning, in accordance with the present invention.
Figure 5B:
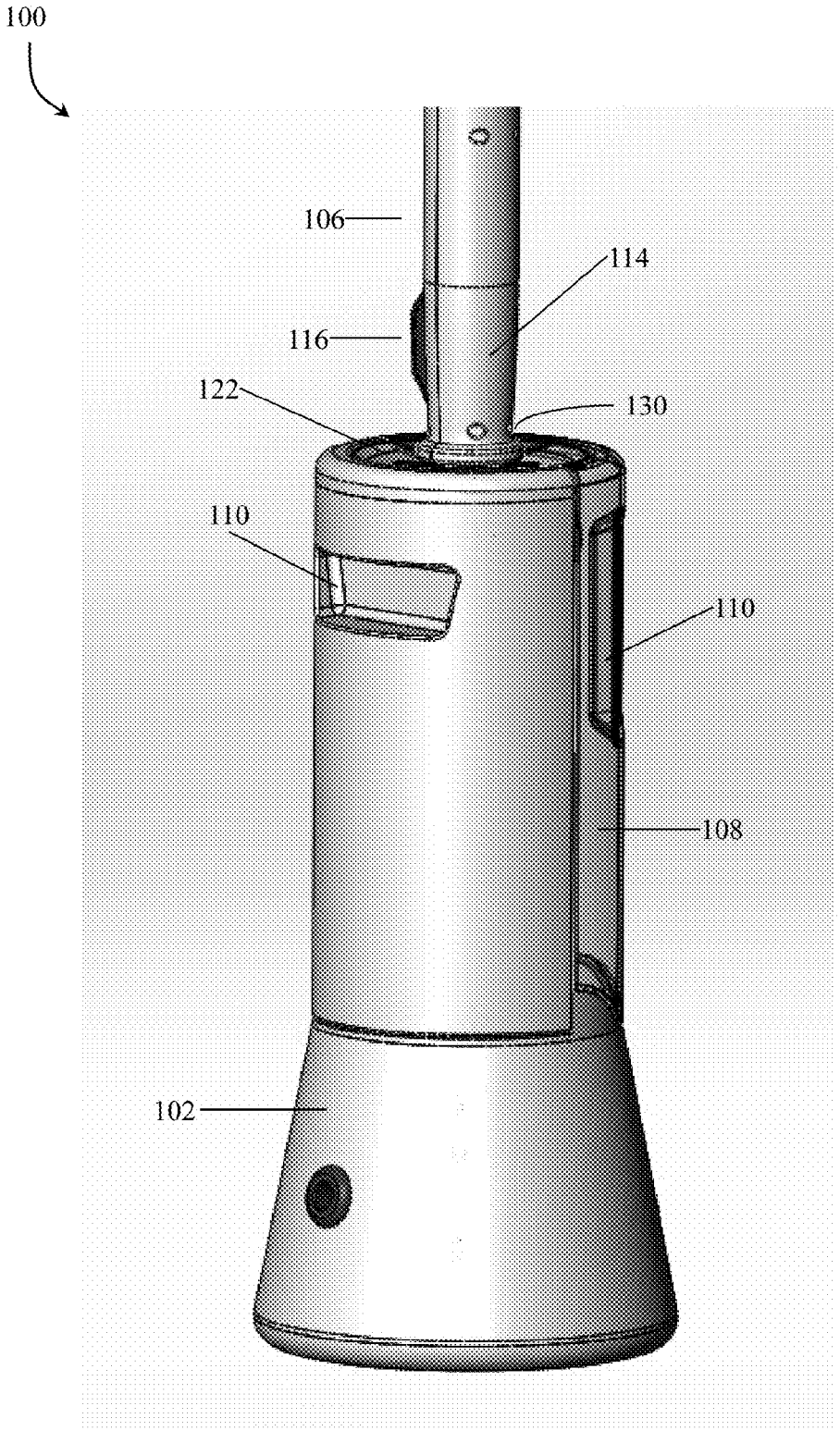

FIGS. 5A and 5B depict example illustrative alternate designs for the system 100 as discussed with respect to FIGS. 1A and 1B. In particular, FIGS. 5A and 5B depict a system 100 with a cone shaped base station 102, instead of the cylindrical shape of the base station 102 depicted in FIGS. 1A and 1B. As would be appreciated by one skilled in the art, each of the components of the system 100 can be shaped and configured in numerous ways while maintaining the functionality of the present invention. Additionally, FIGS. 1A, 1B, 5A, and 5B are illustrative depictions of the present invention with the elongate tube 118 and nozzle 120 of the handheld liquid dispensing wand 106 mounted within the mounting bracket of the base station 102, and the present invention is not intended to be limited to this configuration. As discussed herein, the present invention can also be configured with the handheld liquid dispensing wand 106 being removed from the base station (e.g., during operation). The shapes and configurations of the components for the system 100 in FIGS. 1A to 8 are for illustrative purposes only.

Figure 6:
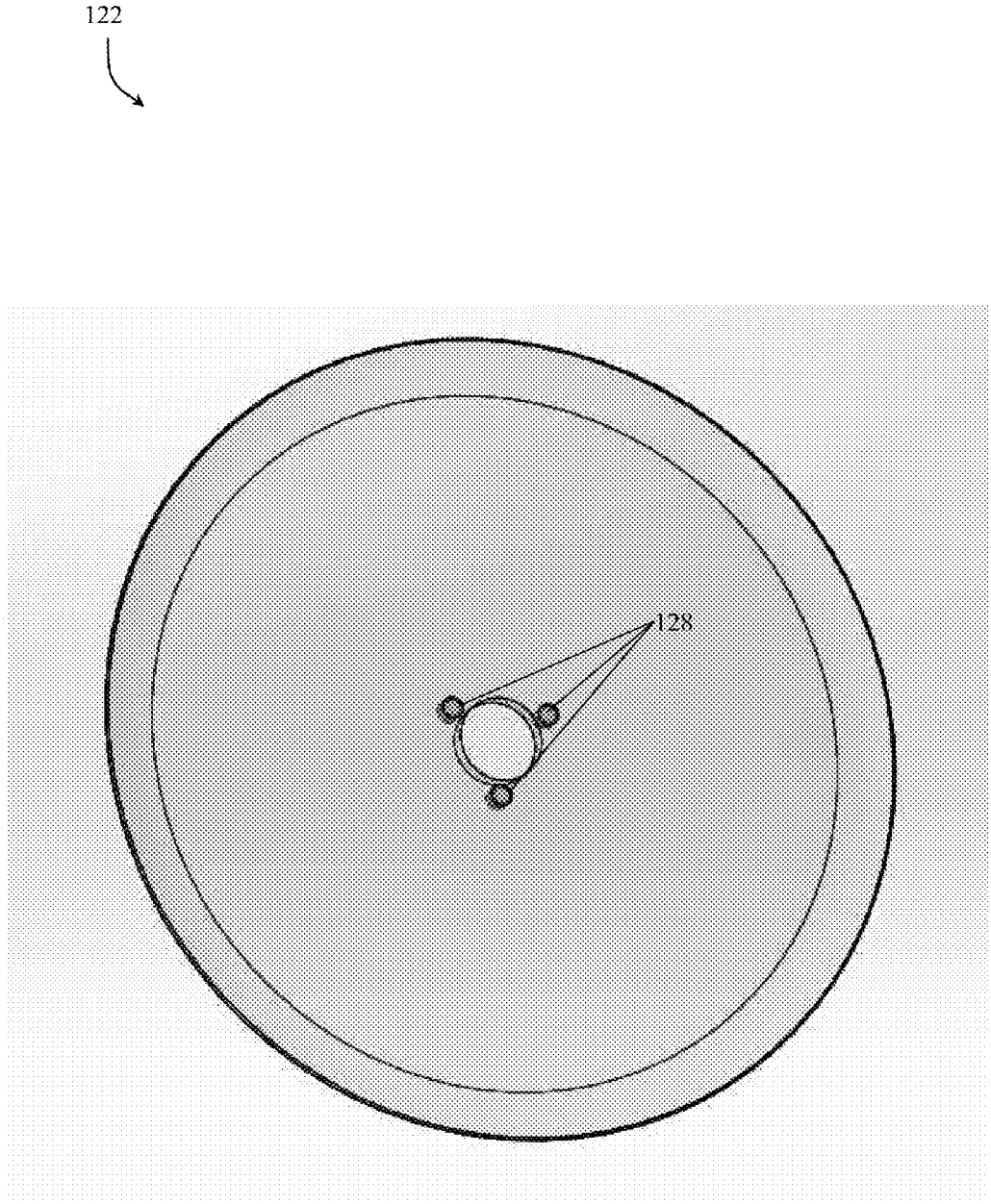
FIG. 6 is an illustrative depiction of a splash guard for a liquid dispensing wand, in accordance with the present invention.

FIG. 6 depicts an example illustrative view of the splash guard 122. In accordance with an example embodiment of the present invention, the handheld liquid dispensing wand 106 includes the splash guard 122. In particular, the splash guard 122 is disposed orthogonal to the longitudinal axis of the elongate tube 118. In accordance with an example embodiment of the present invention, the splash guard 122 has a disk shaped structure, as depicted in FIG. 6. As would be appreciated by one skilled in the art, the shape of the splash guard 122 can include any shape and positioning that is conducive to blocking overspray and splash back created during operation of the system 100. For example, the splash guard 122 can be a flat structure, a concave or convex curved structure, an angled structure, or an irregular shaped structure. In accordance with an example embodiment of the present invention, the splash guard can be slidably attached to the elongate tube 118 such that the splash guard 122 can move between a first end 118*a* and a second end 118*b* of the elongate tube 118 without detaching from the handheld liquid dispensing wand 106, as discussed further with respect to FIGS. 11, 12A, 12B, and 12C. As would be appreciated by one skilled in the art, the splash guard 122 can also be removable and/or disposable (that is, made of a material and structure that is conventionally considered disposable, as would be understood by those of skill in the art). The disposable splash guards 122 can be made of biodegradable and/or septic tank compliant material and structure. Furthermore, the material and structure of the splash guard 122 (slidably attached or removable) can enable the splash guard 122 to be washable, reusable, or both, as would also be appreciated by those of skill in the art.

Figure 12C:
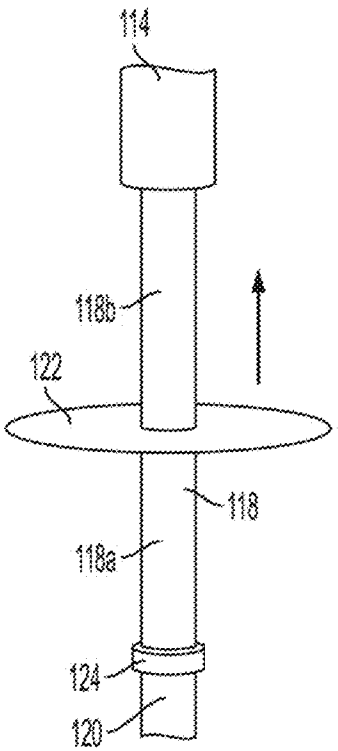
FIGS. 12A, 12B, and 12C are illustrative step-wise depictions of an operation of the splash guard of the liquid dispensing wand, in accordance with aspects of the invention.
Figure 12B:
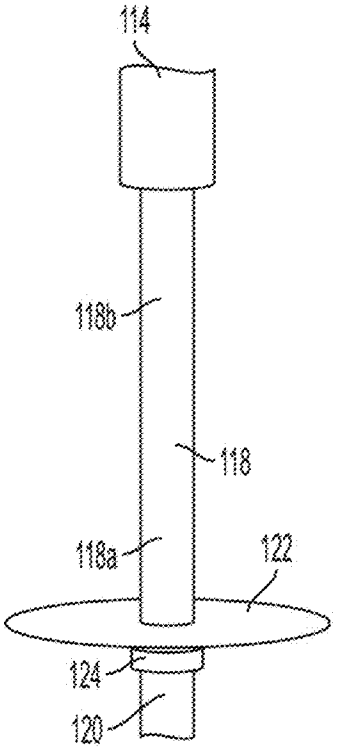
Figure 12A:
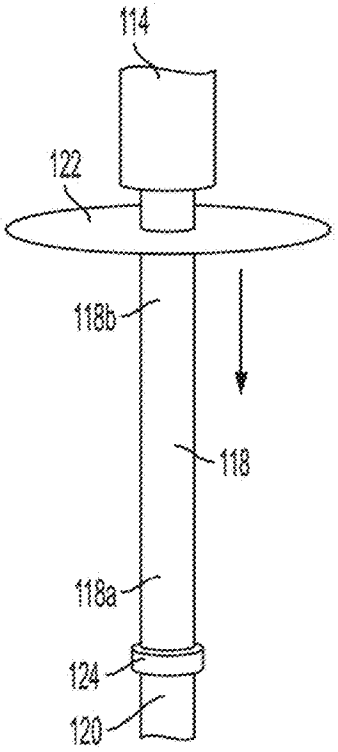

In accordance with an example embodiment of the present invention, the splash guard 122 can be slidably coupled with the elongate tube 118. In particular, the splash guard 122 is configured to be slidable longitudinally between an operational position proximal a first end 118*a* of the elongate tube 118 and a storage position proximal a second end 118*b* of the elongate tube 118, as depicted in FIGS. 12A, 12B, and 12C. In accordance with an example embodiment of the present invention, the splash guard 122 can be slidably coupled with a mounting bracket 123 that is itself slidable longitudinally between the first end 118*a* and the second end 118*b* of the elongate tube 118, thereby enabling the splash guard 122 to be slidable longitudinally between the operational position proximal the first end 118*a* of the elongate tube 118 and the storage position proximal the second end 118*b* of the elongate tube 118. When the splash guard 122 is positioned in the operational position proximal the first end 118*a* of the elongate tube 118, reflected spray bouncing off of a target surface receiving liquid jetting from the nozzle 120 of the handheld liquid dispensing wand 106 impacts the splash guard 122 and does not reach the second end 118*b* of the elongate tube 118. By not reaching the second end 118*b* of the elongate tube 118, any reflected spray or splash back is prevented from reaching a user's arm or hand operating the handheld liquid dispensing wand 106. As such, the splash guard 122 guards the user from being exposed to contaminants resulting from the cleaning of the surface.

Figure 7:
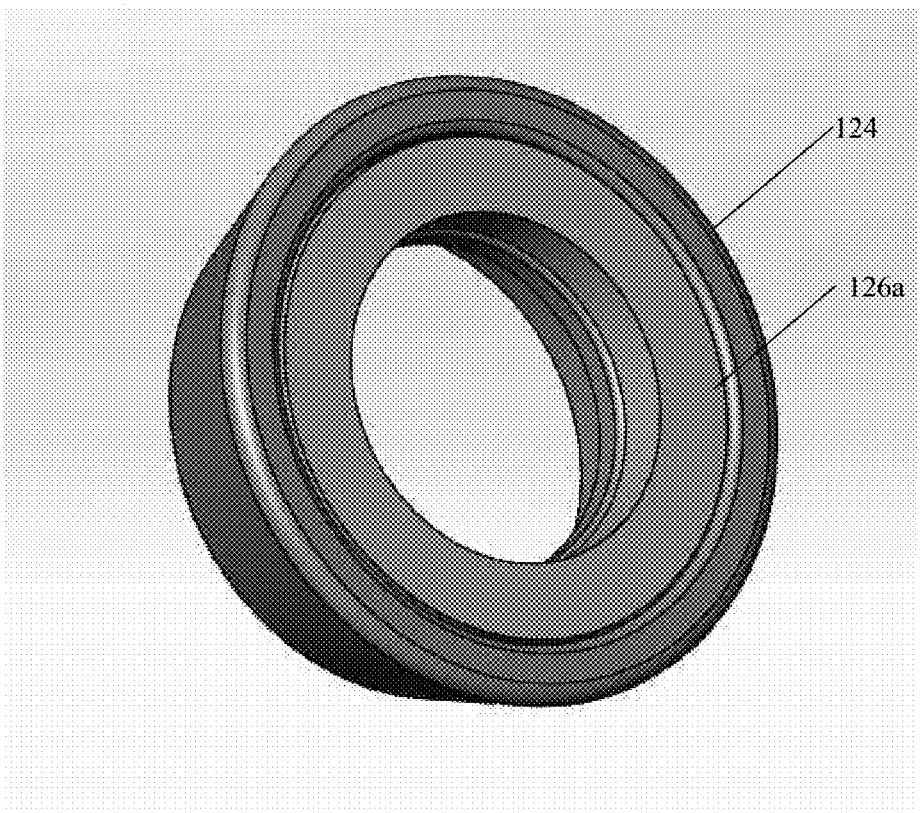
FIG. 7 is an illustrative depiction of a mechanical stop/fastening mechanism for a splash guard for a liquid dispensing wand, in accordance with the present invention.

In accordance with an example embodiment of the present invention, a mechanical stop 124 can be disposed proximal the first end 118*a* and the nozzle 120. As would be appreciated by one skilled in the art, the mechanical stop 124 can be a separate component or included as part of the nozzle 120. FIG. 7 depicts an illustrative example of the mechanical stop 124. In particular, FIG. 7 depicts a mechanical stop 24 that can be situated at the first end 118*a* of the elongate tube 118, as depicted in FIGS. 9, 12A, 12B, and 12C. In operation, the mechanical stop 124 prevents the splash guard 122 from sliding beyond the point of the mechanical stop 124 on the elongate tube 118, prior to reaching the nozzle 120, while holding the splash guard 122 in the operational position. In accordance with an example embodiment of the present invention, the mechanical stop 124 can include a fastening and releasing mechanism 126. The fastening and releasing mechanism 126 can releasably couple the splash guard 122 to the mechanical stop 124 in the operational position of the splash guard 122 (e.g., at a first end 118*a* of the elongate tube 118). In accordance with an example embodiment of the present invention, the fastening and releasing mechanism 126 can include a first magnet 126 (e.g., a magnetic ring) coupled with the mechanical stop 124 and a second magnet(s) 128 coupled with the splash guard 122, the first magnet 126 and second magnet(s) 128 being oriented to magnetically couple with one another. As would be appreciated by one skill in the art, either the first magnet 126 or the second magnet(s) 128 can include a single magnet or a plurality of magnets or can be replaced with a metal component while maintaining similar functionality. Similarly, other fastening mechanisms known in the art can be used in place of the magnets 126, 128 and metal component. For example, a latching or friction force mechanism can be used in place of the magnetic force mechanism for fastening and releasing the splash guard 122 between the first end 118*a* and the second end 118*b* along the elongate tube 118.

Figure 8:
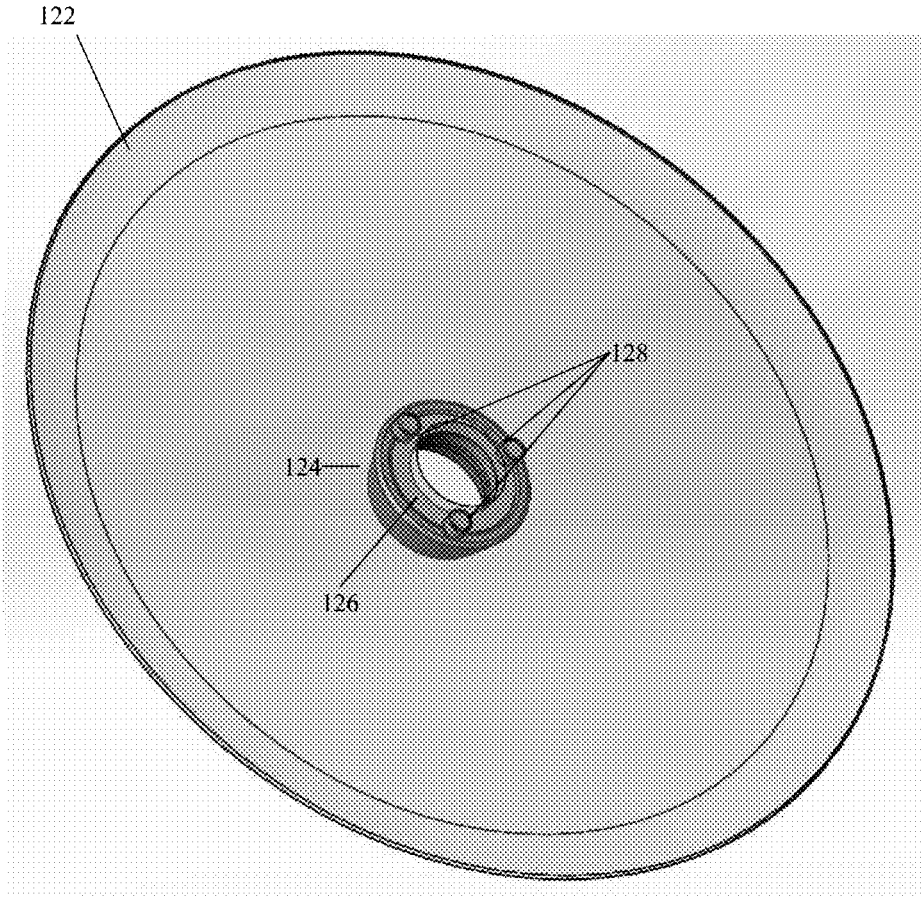
FIG. 8 is an illustrative depiction of a mechanical stop/fastening mechanism and a splash guard for a liquid dispensing wand, in accordance with the present invention.

FIG. 8 depicts and illustrative embodiment of the splash guard 122 including the second magnet(s) 128 coupled to the mechanical stop 124 including the first magnet 126. During operation, the splash guard 122 is positioned at the mechanical stop 124 and held in place by the magnetic force between the first magnet 126 of the mechanical stop 124 and the second magnet(s) 128 of the splash guard 122. Once the cleaning operation is complete, the splash guard 122 can be decoupled from the mechanical stop 124 by applying a force sufficient to break the magnetic bond between the first magnet 126 and the second magnet(s) 128, as discussed in greater detail with respect to FIGS. 12A, 12B, and 12C. In particular, when a user re-sheathes the handheld liquid dispensing wand 106 in the holster of the base station 102, the physical act of putting the handheld liquid dispensing wand 106 back in the holster breaks the magnetic bond between the splash guard 122 disk magnets 128 and the mechanical stop 124 magnet 126.

Figure 9:
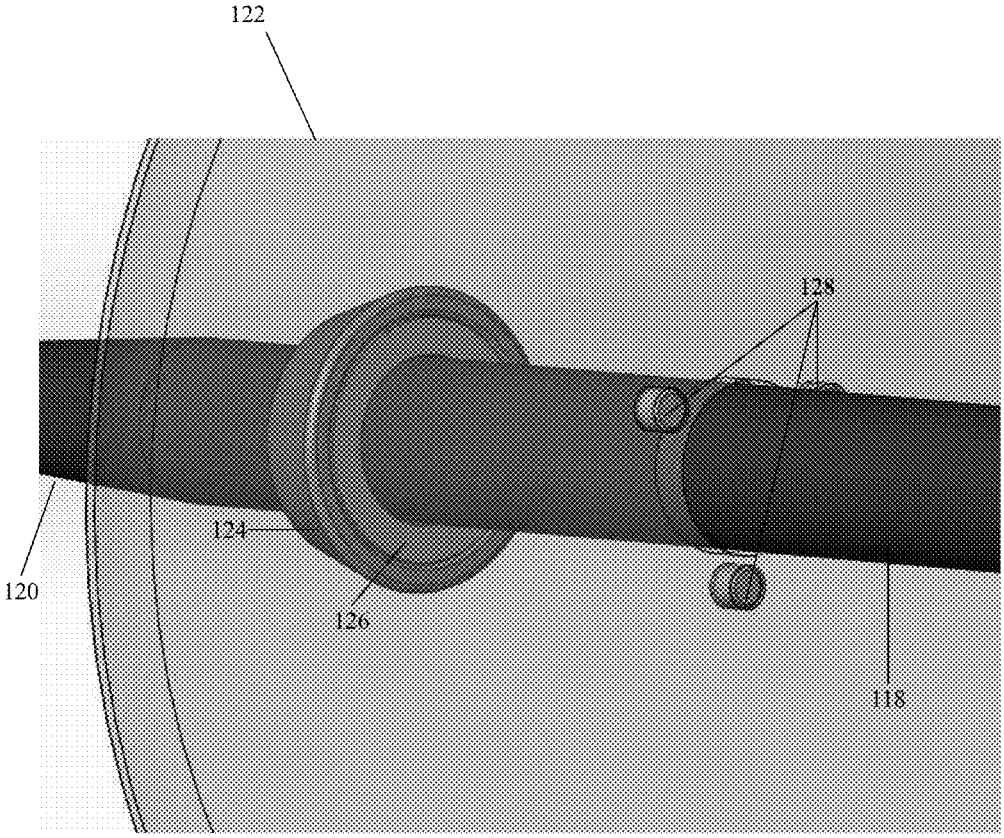
FIG. 9 is an illustrative depiction of a mechanical stop/fastening mechanism and a splash guard for a liquid dispensing wand, in accordance with the present invention.

FIG. 9 depicts an example illustrative embodiment of the splash guard 122 positioned proximal the first end 118*a* of the elongate tube 118 during operation. In particular, FIG. 9 depicts the elongate tube 118 with the splash guard 122 and the mechanical stop 124 positioned proximate to each other at the first end 118*a* of the elongate tube 118 prior to the nozzle 120. In accordance with an example embodiment of the present invention, the splash guard 122 includes the second magnet(s) 128 embedded therein and the mechanical stop 124 includes the first magnet 126 embedded therein. When the first magnet 126 and the second magnet(s) 128 are positioned to realize a magnetic attraction force there between, the splash guard 122 can be held in place at the mechanical stop 124 until the magnetic force between the first magnet 126 and the second magnet(s) 128 is broken.

Figure 10:
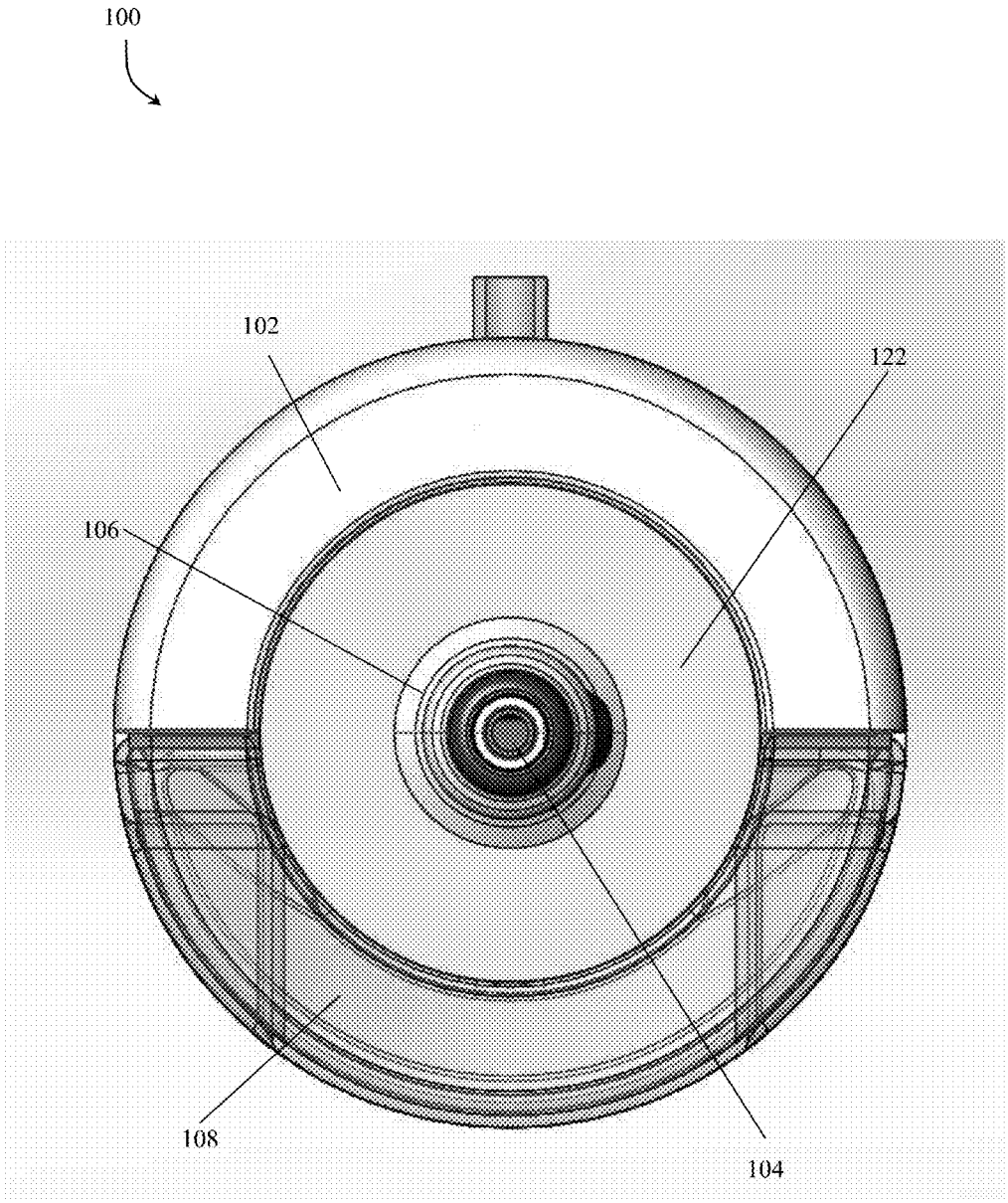
FIG. 10 is a top illustrative view of a liquid dispensing wand, in accordance with the present invention.

FIG. 10 depicts an illustrative example of a top view of the system 100, as discussed with respect to FIGS. 1-9. In particular, FIG. 10 depicts an example illustrative embodiment of a top view of the base station 102 coupled to or including the liquid basin 108, the splash guard 122, the hose 104, and the handheld liquid dispensing wand 106. In accordance with an example embodiment of the present invention, the splash guard 122 can rest on the top of the base station 102 and can be slidably attached to the end of the handheld liquid dispensing wand 106, at the second end 118*b* of the elongate tube 118, as discussed in greater detail with respect to FIGS. 12A, 12B, and 12C. In accordance with an example embodiment of the present invention, a stack of disposable splash guards 122 can be placed on the top of the base station 102 to be removed individually using a similar mechanism, as discussed in greater detail with respect to FIGS. 12A, 12B, and 12C.

Figure 11:
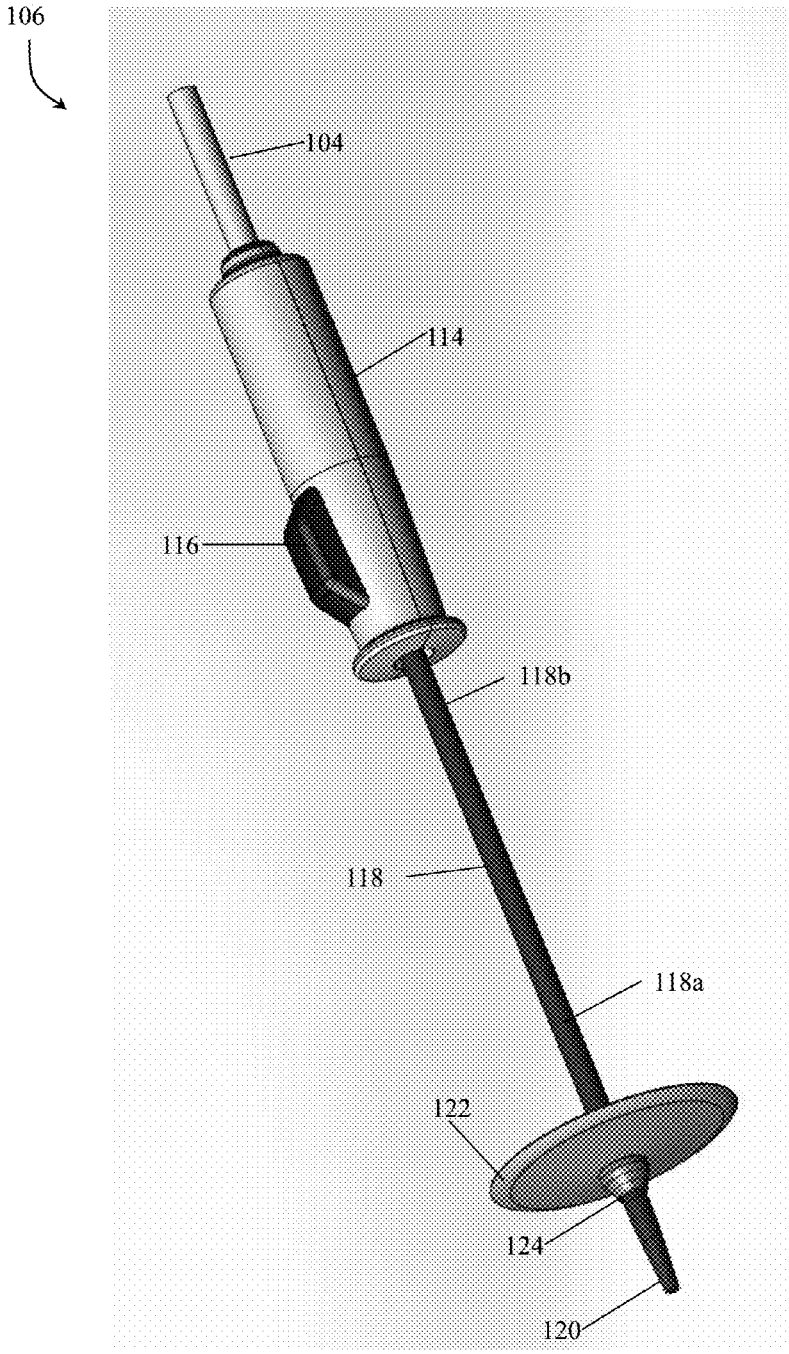
FIG. 11 is an illustrative depiction of a liquid dispensing wand, in accordance with the present invention.

An exemplary example of the handheld liquid dispensing wand 106 with the splash guard 122 is depicted in FIGS. 12A, 12B, and 12C. In particular, FIGS. 12A, 12B, and 12C depict the handheld liquid dispensing wand 106 including the hose 104, the handle 114, the actuator 116, the elongate tube 118, the first end 118*a* of the elongate tube, the second end 118*b* of the elongate tube, the splash guard 122, the mechanical stop 124, and the nozzle 120, as discussed with respect to FIGS. 1-10. As depicted in FIG. 11, the splash guard 122 is located at the first end 118*a* of the elongate tube 118 coupled to the mechanical stop 124 (e.g., via magnetic force of other fastening mechanism) near the nozzle 120. The location of the splash guard 122 at the first end 118*a* indicates that the handheld liquid dispensing wand 106 is in the operating position and is ready to be activated to spray pressurized liquid (e.g., by pressing the actuator 116). As discussed herein, upon return of the handheld liquid dispensing wand 106 to the base station 102 mount, the splash guard will be slidably moved to the first end 118*a* for storage, as depicted in FIGS. 1A, 1B, 5A, 5B, and 10 and as further discussed with respect to FIGS. 12A-12C.

In the implementation of removable and/or disposable splash guard(s) 122, the mechanical stop 124 can be replaced by a fastening and releasing mechanism 126. The fastening and releasing mechanism 126 can be an actuating latch or other mechanical mechanism (as would be readily understood by one of skill in the art) configured to hold the splash guard 122 in place during operation and releasably decouple the removable and/or disposable splash guard 122 upon completion of the operation. For example, the fastening and releasing mechanism 126 can grip the splash guard 122 at the operational position and can be configured to decouple and release the splash guard 122 at the end of the operation. As would be appreciated by one skilled in the art, the fastening and releasing mechanism 126 can include any combination of mechanical retractable latches, or other fastening and releasing mechanisms known in the art. In accordance with an example embodiment of the present invention, the fastening and releasing mechanism 126 can be proximal the first end 118*a* of the elongate tube 118 and can be configured to grab one or more splash guards (e.g., resting on top of the base station 102 as depicted in FIGS. 1A, 1B, 5A, and 5B) when the handheld liquid dispensing wand 106 is removed from the base station 102. During operation of the handheld liquid dispensing wand 106 the splash guard 122 remains proximal the first end 118*a* of the elongate tube 118 before the nozzle 120 and can be released once the cleaning operation is complete. In accordance with an example embodiment of the present invention, the actuator 116 on the handle 114 of the handheld liquid dispensing wand 106 can be pressed to cause the actuating latches to compress (e.g., into the elongate tube 118) and release the splash guard 122. As would be appreciated by one skilled in the art, the actuator 116 can be used to release the splash guard 122 using any combination of mechanical and electrical means known in the art.

In accordance with an example embodiment of the present invention, the base station 102 can include a mounting system 130 configured for removably storing the handheld liquid dispensing wand 106 when not in use. The mounting system 130 can be a hollow chamber 111 extending longitudinally through the base station 102, configured to encase the elongate tube 118 and the nozzle 120 within the base station 102, as depicted in FIGS. 1A, 1B, 5A, and SB. Alternatively, the mounting system 130 can be a holster to allow the entirety of the handheld liquid dispensing wand 106 to rest on an exterior of the base station 102. When the handheld liquid dispensing wand 106 is placed into the mounting system, the splash guard 122 impacts a structure of the base station 102 which prevents the splash guard 122 from moving with the elongate tube 118 and instead causes the elongate tube 118 and the splash guard 122 to slide relative to each other, longitudinally moving the splash guard 122 from the second end 118*b* to the first end 118*a* of the elongate tube 118, as discussed in greater detail in FIGS. 12A, 12B, and 12C. In particular, with the splash guard 122 disposed proximal the first end 118*a* of the elongate tube 118 and the nozzle 120, placement of the handheld liquid dispensing wand 106 into the mounting system for storing causes the splash guard 122 to slide from the first end 118*a* to the second end 118*b* of the elongate tube 118, as depicted in FIGS. 12A, 12B, and 12C. In accordance with an example embodiment of the present invention, the base station 102 can include a retraction mechanism (as would be understood by one of skill in the art) to retract the hose 104 when the handheld liquid dispensing wand 106 can be mounted to the base station 102. In accordance with an example embodiment, the base station 102 can include an anchor (as would be understood by one of skill in the art) to keep the base station 102 firmly seated and upright when removing and returning the handheld liquid dispensing wand 106. For example, the base station 102 can include a weight and/or suction cups on a bottom surface to anchor the base station 102 (e.g., via an anchor) and keep itself upright.

In operation, the handheld liquid dispensing wand 106 of the system 100 can create a liquid jet stream to clean a toilet or other fixture. In particular, the handheld liquid dispensing wand 106 can be used by a user to activate a pressurized stream of liquid to be used to clean, e.g., a toilet bowl or other fixture. Beginning at a resting position, as depicted in FIGS. 1A, 1B, 5A, and 5B, the handheld liquid dispensing wand 106 is mounted within or holstered on the base station 102. The user can grab the handheld liquid dispensing wand 106 by the handle 114 and remove the handheld liquid dispensing wand 106 from the mounting system 130. In accordance with an example embodiment of the present invention, the removal of the handheld liquid dispensing wand 106 from the base station 102 initiates the process of positioning and/or attaching the splash guard 122 at an operational position on the handheld liquid dispensing wand 106, as discussed with respect to FIGS. 12A, 12B, and 12C.

FIGS. 12A, 12B, and 12C depict example implementations of the handheld liquid dispensing wand 106 and splash guard 122 positioning process. In particular, FIGS. 12A, 12B, and 12C depict how the splash guard 122 is slidably positioned at the first end 118*a* of the elongate tube 118 and held in place by the mechanical stop 124 or mechanical fastener proximate to the first end 118*a* of the elongate tube 118 after being removed from the base station 102. In accordance with an example embodiment of the present invention, the splash guard 122 can be positioned at a resting position, on top of the base station 102, proximal to the second end 118*b* of the elongate tube 118. FIG. 12A depicts the initial positioning of the splash guard 122 at the second end 118*b* of the elongate tube 118 adjacent to the handle 114 of the handheld liquid dispensing wand 106 resting on top of the base station 102 during storage. When the handheld liquid dispensing wand 106 is removed/pulled out of the mounting system 130 of the base station 102, the splash guard 122 will slidably reposition from the second end 118*b* of the elongate tube 118 toward the first end 118*a* of the elongate tube 118. In accordance with an example embodiment of the present invention, the splash guard 122 can be slidably repositioned by sliding down the elongate tube 118 by gravitational force. As would be appreciated by one skilled in the art, the splash guard 122 can be slidably repositioned from the second end 118*b* of the elongate tube 118 to a first end 118*a* of the elongate tube 118 by any means known in the art. For example, the elongate tube 118 can include a mechanical spring mechanism to push the splash guard 122 from one position to another (e.g., from the resting position to a stop position).

FIG. 12B depicts the positioning of the splash guard 122 after sliding down the elongate tube 118 to the mechanical stop 124 or being pushed down by a spring to a stop position. The mechanical stop 124 prevents the splash guard 122 from traveling beyond the position of the mechanical stop 124. Once the splash guard 122 is positioned adjacent to the mechanical stop 124, the splash guard 122 can be coupled to the mechanical stop 124. As discussed with respect to FIGS. 4-11, the splash guard 122 and the mechanical stop 124 can be coupled together using magnetic force between the first magnet 126 and the second magnet(s) 128. As would be appreciated by one skilled in the art, the splash guard 122 can be coupled to the mechanical stop 124 or another portion of the elongate tube 118. For example, the elongate tube 118 can include mechanical latches configured to grasp the splash guard 122 either at the start position in FIG. 12A or at the stop position in FIG. 12B. The mechanical latches will hold the splash guard 122 in place during operation. Regardless of the coupling mechanism, the splash guard 122 can be held in place at the stop position throughout the operation of the system 100.

Once the splash guard 122 is positioned at the first end 118*a* of the elongate tube 118 and coupled with the mechanical stop 124 or fastening mechanism, as depicted in FIG. 12B, the user can begin operation of a pressurized liquid jet stream via the handheld liquid dispensing wand 106. The user can direct the handheld liquid dispensing wand 106 in the direction of the cleaning surface (e.g., toilet bowl) and initiate the jet stream of liquid to clean the surface (e.g., bowl). To initiate the stream the user can activate the actuator 116 on the handle 114 of the handheld liquid dispensing wand 106. When the actuator 116 is activated, a control signal is transmitted to the base station 102 and the pump mechanism can begin pumping the liquid from the liquid basin 108 through the host 104 and elongate tube 118 to the nozzle 120. As would be appreciated by one skilled in the art, the liquid basin 108 can be filled, previous to operation of the system 100, with a combination of water and/or cleaning solution. The combined jet stream of the liquid and the cleaning solution(s) can effectively cleanse the surface at which the jet stream is directed. Additionally, with the splash guard 122 in the operational position, the user and the surrounding area will be protected from any overspray or splash back created by the jet stream of liquid. The user can stop the jet stream of liquid by deactivating the actuator 116.

After the user has completed cleaning the surface or fixture and deactivated the liquid jet stream, the splash guard 122 can be released for disposal or cleaning and/or returned to the base station 102 along with the handheld liquid dispensing wand 106. In the event that disposable splash guards 122 are being utilized, the actuating latches holding the splash guard 122 can be withdrawn causing the splash guard 122 to decouple from the handheld liquid dispensing wand 106 and disposed in a waste container or to be flushed down the toilet. FIG. 12C depicts an illustrative embodiment of a reusable splash guard 122 being returned to a resting position on top of the base station 102. In accordance with an example embodiment of the present invention, the splash guard 122 is repositioned when the handheld liquid dispensing wand 106 is mechanically inserted on/within the base station 102 by inserting the nozzle 120 and elongate tube 118 into a mounting system 130 (e.g., a chamber or holster). As the handheld liquid dispensing wand 106 is inserted into the mounting system 130, the splash guard 122 will be positioned on the top of the base station 102, as depicted in FIGS. 1A, 1B, 5A, 5B, and 10, and remain in place at the top of the base station 102 as the elongate tube 118 slides past/through the stationary splash guard 122. As would be appreciated by one skilled in the art, the mechanical slotting on the nozzle 120 and elongate tube 118 into the mounting chamber or holster is performed with sufficient force to decouple the splash guard 122 from the mechanical stop 124. For example, slotting the nozzle 120 and elongate tube 118 into the mounting chamber or holster can be performed by applying enough force to break the magnetic bond between the first magnet 126 and the second magnet 128 and/or to compress the spring mechanism used to position the splash guard 122, as discussed with respect to FIGS. 12A and 12B. With the handheld liquid dispensing wand 106 is fully mounted/holstered on the base station 102 and the splash guard 122 returned to a rest position on top of the base station 102, the system 100 is in a storage position and/or standby state until the next use.

Figure 13:
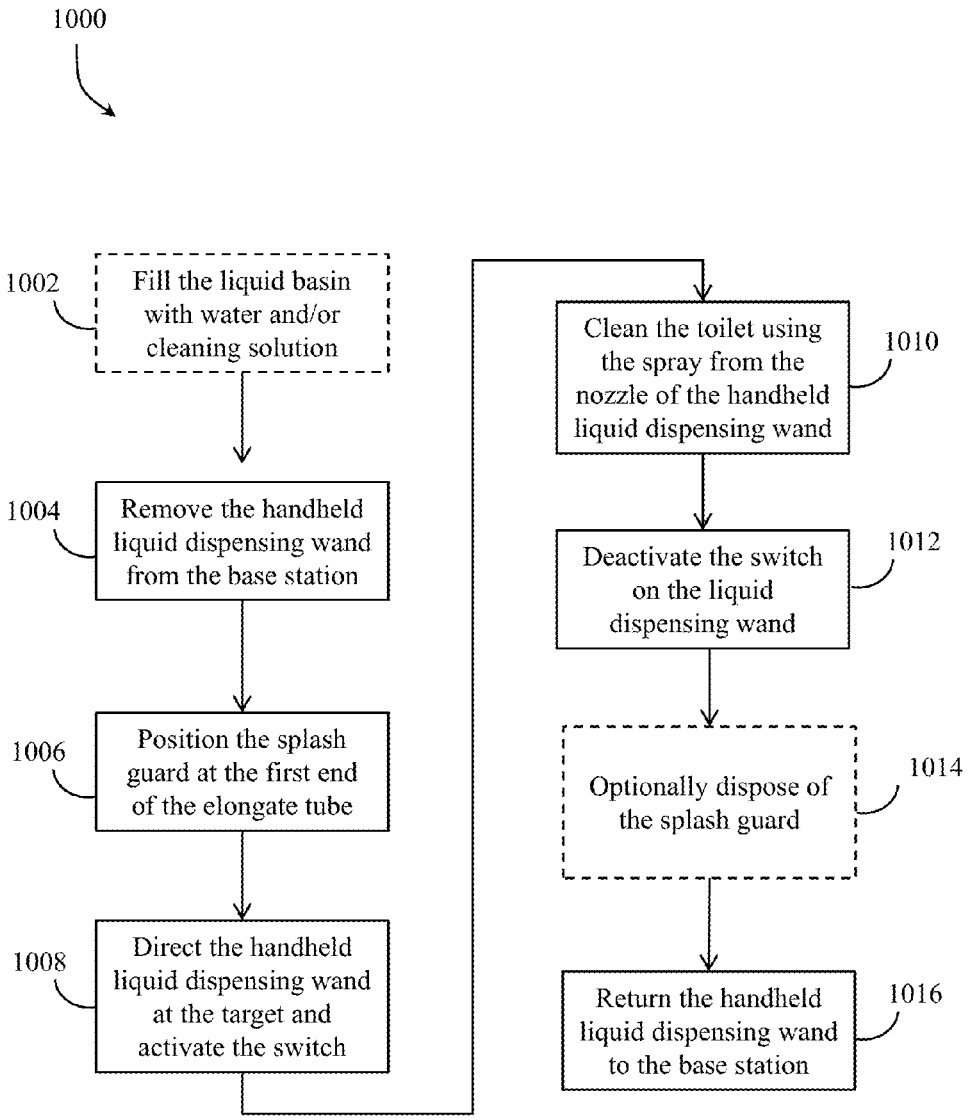
FIG. 13 is an illustrative flowchart depicting an exemplary operation of the liquid dispensing wand of the system for cleaning, in accordance with aspects of the present invention.

FIG. 13 shows an exemplary flow chart depicting implementation of the present invention. Specifically, FIG. 13 depicts an exemplary flow chart showing a process 1000 for using the system 100, as discussed with respect to FIGS. 1-12C. In particular, FIG. 13 depicts a method of using the system 100 when cleaning a toilet or other fixture. At step 1002, the user fills the liquid basin 108 with water and/or cleaning solution. For example, the user can detach the liquid basin 108 from the base station 102 and fill the liquid basin 108 with water from the sink, fill the liquid basin 108 with a cleaning solution, or a combination thereof. The step 1002 of filling the liquid basin 108 is optional in that the liquid basin 108 may not in every instance require filling because there may be a sufficient quantity of water in the liquid basin 108 from a prior filling. In accordance with an example embodiment of the present invention, the liquid basin 108 can include a replaceable container pre-filled with cleaning solution (e.g., store bought cleaning supply).

At step 1004, the user removes the handheld liquid dispensing wand 106 from the base station 102. The user can remove the handheld liquid dispensing wand 106 by pulling it from the mounting system 130 within the base station 102, as discussed with respect to FIG. 12A. At step 1006, the splash guard 122 is positioned at the first end 118*a* of the elongate tube 118. The splash guard 122 can be automatically positioned by gravity force or spring force, as discussed with respect to FIG. 12B, or can be positioned with manual assistance from the user. For example, the user can slide the splash guard 122 into position and/or tilt the handheld liquid dispensing wand 106 at an appropriate angle to allow the splash guard 122 to slide into place. As discussed with respect to FIG. 12B, once positioned, the splash guard 122 is coupled into place via the mechanical stop 124 (e.g., magnetism) or by a fastening and releasing mechanism 126.

At step 1008, the user can direct/aim the handheld liquid dispensing wand 106 at the toilet or other fixture being cleaned and activate the actuator 116 to initiate the pressurized liquid jet stream. The pressurized liquid jet stream is created by the pump within the base station 102 pumping the liquid from the liquid basin 108 through the hose 104 and elongate tube 118 to the nozzle 120. The pressurized liquid jet stream is creates a powerful cleaning force sufficient for cleaning the surface of the toilet or other fixture. For example, the liquid jet stream can be at a pressure between 10 psi and 100 psi (pounds per square inch). In accordance with an example embodiment, the pressure is 50 psi or greater. At step 1010, the user directs the pressurized liquid jet stream throughout the toilet or other fixture surface to remove any visible and non-visible material waste. At step 1012, once the toilet or other fixture has been sufficiently cleaned, the user can deactivate the actuator 116 to stop the pressurized liquid jet stream. As would be appreciated by one skilled in the art, the deactivated actuator 116 can transmit a control signal to the base station 102 to stop pumping the liquid from the liquid basin 108.

Continuing with FIG. 13, at optional step 1014, the user can dispose of the splash guard 122, in the case of removable splash guards 122. If the splash guard 122 is slidably attached to the elongate tube 118 and not removable, then step 1014 is skipped. Disposal of the splash guard 122 can include retracting a latching mechanism holding the splash guard 122 in place to decouple the splash guard 122 from the rest of the handheld liquid dispensing wand 106. As would be appreciated by one skilled in the art, the disposable splash guard 122 can be made from biodegradable material that is designed of flushable and septic tank compliant material. At step 1016, the user can return the handheld liquid dispensing wand 106 and splash guard 122 to the base station 102 for storage. The user can return the handheld liquid dispensing wand 106 and splash guard 122 by sliding the handheld liquid dispensing wand 106 into the mount or holster of the base station 102. During the mounting or holstering process, the splash guard 122 can be returned to a resting position on top of the base station 102, as discussed with respect to FIG. 12C.

The system 100 and cleaning method is very different from using a traditional toilet brush in that the system 100 creates a high-pressure stream of water to clean with instead of bristles. As a result the handheld liquid dispensing wand 106 never gets dirty. The system 100 is also very convenient to use rapidly immediate cleaning after toilet use. The system 100 never needs to be replaced like a traditional toilet brush. Additionally, the splash guard 122 provides protection to the user from splash back caused by the high-pressure stream of water.

Unless otherwise noted or defined herein, to the extent directional vocabulary is utilized, the disclosure and figures are described with reference to a conventional three-dimensional coordinate axis system of X, Y and Z, where the X direction is generally left-right or east-west, the Y direction is generally in-out, relative to the plane of the page of the document, and the Z direction is generally up-down or north-south on the page. Further as utilized herein, the terms "horizontal" and "vertical" are utilized consistent with their conventional definitions as would be appreciated by those of skill in the art, and as generally illustrated and expanded upon below. For example, in the fields of physics, engineering, and construction, the direction designated as vertical is usually that along which a plumb-bob hangs in response to the force of gravity. The direction of horizontal is considered along a line or plane that is normal or orthogonal to the vertical plane. As such, moving in a horizontal direction (horizontally) is effectively equivalent to traveling across the earth's surface, e.g., moving forward, backward, left, right, etc., along the ground, while moving in a vertical direction (vertically) is effectively equivalent to moving up (away from the ground) or down (toward or into the ground). Merging the X, Y, Z coordinate access with the terms vertical and horizontal, the Z-axis lies in the vertical direction and the X and Y axes lie in the horizontal plane with the vertical Z axis being orthogonal thereto. To the extent any ambiguity is generated by the specific wording of the above explanations, it is anticipated that such ambiguity may be interpreted and clarified consistent with the conventional interpretations of the terms horizontal and vertical.

As utilized herein, the terms "comprises" and "comprising" are intended to be construed as being inclusive, not exclusive. As utilized herein, the terms "exemplary", "example", and "illustrative", are intended to mean "serving as an example, instance, or illustration" and should not be construed as indicating, or not indicating, a preferred or advantageous configuration relative to other configurations. As utilized herein, the terms "about" and "approximately" are intended to cover variations that may existing in the upper and lower limits of the ranges of subjective or objective values, such as variations in properties, parameters, sizes, and dimensions. In one non-limiting example, the terms "about" and "approximately" mean at, or plus 10 percent or less, or minus 10 percent or less. In one non-limiting example, the terms "about" and "approximately" mean sufficiently close to be deemed by one of skill in the art in the relevant field to be included. As utilized herein, the term "substantially" refers to the complete or nearly complete extend or degree of an action, characteristic, property, state, structure, item, or result, as would be appreciated by one of skill in the art. For example, an object that is "substantially" circular would mean that the object is either completely a circle to mathematically determinable limits, or nearly a circle as would be recognized or understood by one of skill in the art. The exact allowable degree of deviation from absolute completeness may in some instances depend on the specific context. However, in general, the nearness of completion will be so as to have the same overall result as if absolute and total completion were achieved or obtained. The use of "substantially" is equally applicable when utilized in a negative connotation to refer to the complete or near complete lack of an action, characteristic, property, state, structure, item, or result, as would be appreciated by one of skill in the art.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated that embodiments may be variously combined or separated without parting from the invention. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A cleaning system, comprising:

a liquid dispensing wand, comprising:

an elongate tube having a first end and a second end;

a nozzle disposed at the second end of the elongate tube; and a splash guard slidably coupled with the elongate tube, the splash guard being slidable longitudinally between the first end and the second end of the elongate tube;

a basin configured to hold a liquid;

a conduit fluidly coupling the basin to the liquid dispensing wand; and a mount removably storing the liquid dispensing wand when not in use;

wherein, with the splash guard disposed proximal the second end and the nozzle, placement of the liquid dispensing wand into the mount for storing causes the splash guard to slide from the second end to the first end of the elongate tube.

2. The system of claim 1, wherein the splash guard comprises a flat structure, a curved structure, an angled structure, or an irregular shaped structure.

3. The system of claim 1, wherein the splash guard comprises a disk shaped structure.

4. The system of claim 1, wherein the splash guard is oriented orthogonally to a longitudinal axis of the elongate tube.

5. The system of claim 1, wherein the elongate tube is rigid.

6. The system of claim 1, wherein the nozzle is structured to generate a liquid jet when pressurized liquid is supplied to the nozzle through the elongate tube.

7. The system of claim 1, further comprising a mechanical stop disposed proximal the second end and the nozzle, wherein the mechanical stop prevents the splash guard from sliding beyond the mechanical stop and reaching the nozzle and holding the splash guard in the operational position.

8. The system of claim 7, wherein the mechanical stop comprises a fastening mechanism.

9. The system of claim 8, wherein the fastening mechanism releasably couples the splash guard to the mechanical stop in the operational position of the splash guard.

10. The system of claim 8, wherein the fastening mechanism comprises a first magnet coupled with the mechanical stop and a second magnet coupled with the splash guard, the first magnet and second magnet being oriented to magnetically couple with each other.

11. The system of claim 1, wherein the splash guard is slidably coupled with the elongate tube by a mounting bracket that is itself slidable longitudinally between the first end and the second end of the elongate tube, thereby enabling the splash guard to be slidable longitudinally between the operational position proximal the first end of the elongate tube and the storage position proximal the second end of the elongate tube.

12. The system of claim 11, wherein the splash guard is comprised of a washable, reusable, material and structure.

13. The system of claim 11, wherein the splash guard is comprised of a disposable material and structure.

14. The system of claim 11, wherein the splash guard is comprised of a biodegradable material and structure.

15. The system of claim 11, wherein the splash guard is comprised of a flushable and septic tank compliant material and structure.

16. The system of claim 1, wherein an actuator is disposed proximal the first end of the elongate tube and is operable to decouple the splash guard from the elongate tube when the splash guard is in the operational position proximal the second end.

17. The system of claim 1, wherein when the splash guard is positioned in the operational position proximal the second end of the elongate tube, reflected spray bouncing off of a target surface receiving liquid jetting from the nozzle of the liquid dispensing wand impacts the splash guard and does not reach the first end of the elongate tube, thereby guarding a user's hand operating the liquid dispensing wand from the first end of the elongate tube.

18. The system of claim 1, wherein when the liquid dispensing wand is placed into the mount, the splash guard impacts a structure of the cleaning system that prevents the splash guard from moving with the elongate tube and instead causes the elongate tube and the splash guard to slide relative to each other, longitudinally moving the splash guard from the second end to the first end of the elongate tube.

* * * * *